United States Patent [19]

Broach

[11] 4,261,508

[45] Apr. 14, 1981

[54] COMBUSTION CONTROL SYSTEM

[75] Inventor: George C. Broach, Tulsa, Okla.

[73] Assignee: The G. C. Broach Company, Tulsa, Okla.

[21] Appl. No.: 40,959

[22] Filed: May 21, 1979

[51] Int. Cl.[3] ..... F23N 1/08; G05D 23/00

[52] U.S. Cl. ..... 236/15 BD; 236/20 R; 431/12

[58] Field of Search ..... 236/15 BP, 15 E, 14, 236/20; 431/12

[56] References Cited

U.S. PATENT DOCUMENTS

| | | | |
|---|---|---|---|
| 2,163,510 | 6/1939 | Cantrell et al. | 236/15 BD |
| 2,193,846 | 3/1940 | Stevenson | 236/15 BD |
| 2,866,602 | 12/1958 | Dailey, Jr. et al. | 236/15 BD |
| 2,986,645 | 5/1961 | Smith et al. | 236/14 X |

*Primary Examiner*—William E. Wayner
*Attorney, Agent, or Firm*—Robert E. Massa

[57] ABSTRACT

A method and apparatus for controlling combustion in a process heater provides for efficient control of the combustion with a minimum of components. The apparatus includes means for generating a signal from a condition of a process, such as temperature, or pressure in the case of a boiler. The signal, which may be a pressure signal, is presented in parallel to a needle valve, to a first fluid-responsive relay, and to a second fluid-responsive relay. A volume tank is connected in series to the needle valve and in parallel to the first relay and to the second relay. The first relay communicates with means for controlling the flow of combustion air. The second relay communicates with means for controlling the flow of fuel. When the signal of the process condition is below the point at which a controller is set, then the signal is an increasing pressure signal. When the signal of the process condition is above the point at which the controller is set, then the signal is a decreasing pressure signal. The first relay responds to a higher of two signals to which it is subjected, and the second relay responds to a lower of two signals to which it is subjected. In either case, an increasing pressure signal or a decreasing pressure signal, the arrangement of the needle valve and volume tank causes a delay in the response of either the first or second relay so that a fuel-lean mixture is maintained during any change in the operating conditions of the process. It is readily seen, however, that opposite responsiveness of the process condition control and fuel and air control devices could be utilized and the same effectiveness of a fuel-lean mixture still be maintained, the important responsiveness being a delay in transmitting flow control signals.

12 Claims, 5 Drawing Figures

COMBUSTION CONTROL SYSTEM

BACKGROUND OF THE INVENTION

This invention relates broadly to furnaces, boilers, incinerators, and like equipment wherein fuel is burned.

More particularly, this invention relates to combustion equipment which regulates the flow of combustion air and fuel in response to a signal generated from a condition of a process.

Still more particularly, this invention relates to combustion equipment which will provide a fuel-lean mixture of combustion components as process conditions modify the demand for process heating.

The efficient control of combustion relates to the efficient control of the fuel and combustion oxidant, usually air. Efficient control of combustion is essential in the power industry, chemical industry, and various other process industries.

The amount of heat furnished by the combustion process depends upon the amount of heat needed by the operation requiring the heat, whether for the generation of power, or for the chemical process, or for an oil refinery process. In addition, the amount of heat needed will continually vary, thus requiring continual control of the combustion.

In some industries, particularly the power industry and the chemical industry, the relative efficiency of the combustion process may be accomplished by the use of elaborate control systems, such as computers, various kinds of automatic valves, and electronic controls.

As a result, numerous control systems have been designed to control the combustion processes. And, with time, these systems tend to become more elaborate. Then, as a system becomes more elaborate, the number of components, such as dials, gauges, recorders, computers, and the like, requiring the attention of the operatore, increases. With increased complexity, the probability of someone making a mistake increases greatly. The operator has an increased number of recording devices to observe and maintain, dials to continually observe, and switches to be ready to operate, for example.

SUMMARY OF THE INVENTION

Therefore, the primary object of this invention is to provide a method and apparatus for controlling combustion in a process which is efficient, easy to operate, and economical.

Another object of this invention is to provide a method and apparatus for controlling combustion in a process which will require only a minimum number of control components in order to regulate the combustion effectively.

Still another object of this invention is to provide a method and apparatus for controlling combustion in a process in which fuel and combustion air are easily regulated for more efficient energy consumption.

Still another object of this invention is to provide a method and apparatus for maintaining close control of the combustion in a process.

Another object of this invention is to provide a method and apparatus which can be easily adjusted to regulate a combustion temperature.

Another object of this invention is to provide a method and apparatus for controlling combustion in a process heater in which a combustion temperature may be easily maintained.

Still another object of this invention is to provide a method and apparatus for maintaining close control of the energy consumption in a process heater.

These and other objects of the invention will become apparent from the accompanying description and drawings and attached claims.

This invention describes a greatly simplified and efficient method and apparatus for combustion control by eliminating many sophisticated and highly technical controlling devices commonly shown in other combustion control systems.

By simplifying the combustion control system, this invention reduces the number of control devices which the operator must understand and closely observe. Consequently, the risk of accident caused by inattention of the operator is greatly reduced.

Further, this invention provides for a more efficient combustion control system by assuring a fuel-lean combustion during a change in combustion requirements.

All of these advantages are obtained by the application of very few, and simple, low-cost components.

The method and apparatus of this invention include generating a signal from a condition of a process stream and adapting that signal to actuate various fuel and combustion oxidant control components. The type of signal generated includes a fluid pressure signal, and is usually a pneumatic signal. The condition of the process stream from which the signal is generated is preferably a temperature of the process, or the pressure of a boiler.

In one typical application, a temperature-responsive device measures a temperature of the process and emits a fluid-pressure signal which may be either an increasing pressure signal or a decreasing pressure signal.

The signal is communicated in parallel to a signal-restrictive member, such as a needle valve; to a first signal-responsive device, such as a first fluid-responsive relay; and to a second signal-responsive device, such as a second fluid-responsive relay. The first fluid-responsive device is adapted to respond to a signal of a first characterization, and the second fluid-responsive device is adapted to respond to a signal of a second characterization. The signal-restrictive member is further adaptable to communicate a signal to a signal-collecting device, such as a volume tank, and the signal-collecting device is adaptable to provide a signal of a first characterization and a signal of a second characterization. The signal-collecting device is adaptable to communicate in parallel with the first signal-responsive device and with the second signal-responsive device. The first signal-responsive device is further adaptable to communicate with an air control device which is adaptable to control a flow of combustion air in response to a signal from the first signal-responsive device. The second signal-responsive device is further adaptable to communicate with a fuel control device which is adaptable to control a flow of fuel in response to a signal from the second signal-responsive device.

The invention teaches a method and apparatus for controlling combustion in which fuel-lean combustion is provided during an interval in which the firing rate is changed. For example, when the process system demands more heat, the flow of combustion air is increased prior to an increase in the flow of fuel, thereby maintaining a fuel-lean mixture during the interval of change. Or, when the process system requires the heat to be reduced, the flow of fuel is decreased prior to a decrease in the flow of combustion air, thereby maintaining a fuel-lean mixture during this interval of change.

DESCRIPTION OF THE PREFERRED EMBODIMENTS

Figure 1:
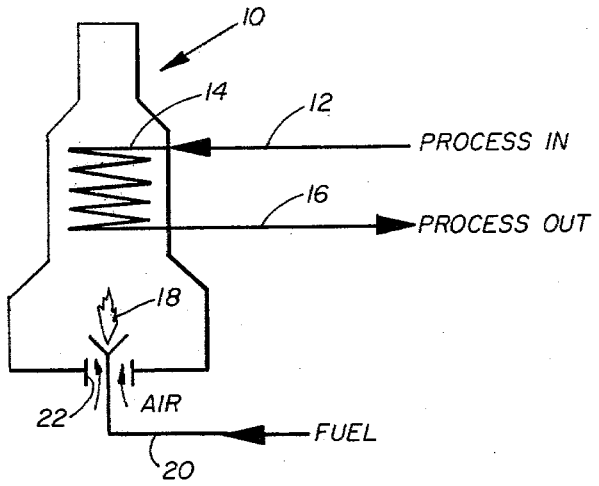
FIG. 1 is a schematic drawing of a typical process heating system.

FIG. 1 describes a typical combustion and heating system for a conventional process industry, which, in its basic arrangement, comprises a furnace or heater 10, generally, having a process inlet stream 12 entering therein, a typical heating coil 14, a process outlet stream 16, and a burner 18 fired by a fuel line 20 and air supplied as through opening 22.

Figure 2:
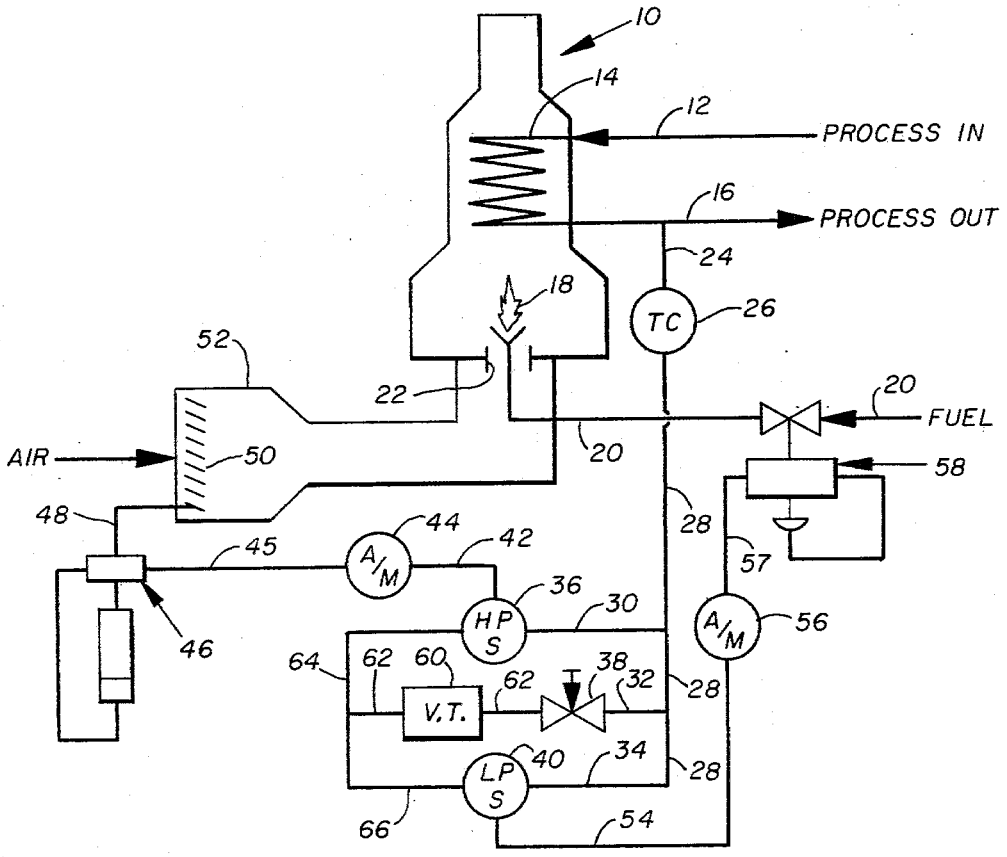
FIG. 2 is a diagrammatic drawing of a combustion control system according to this invention.

FIG. 2 describes, diagrammatically, for added simplicity, one manner in which my invention may be utilized in any type of equipment involving combustion of a fuel and an oxidant.

Figure 3:
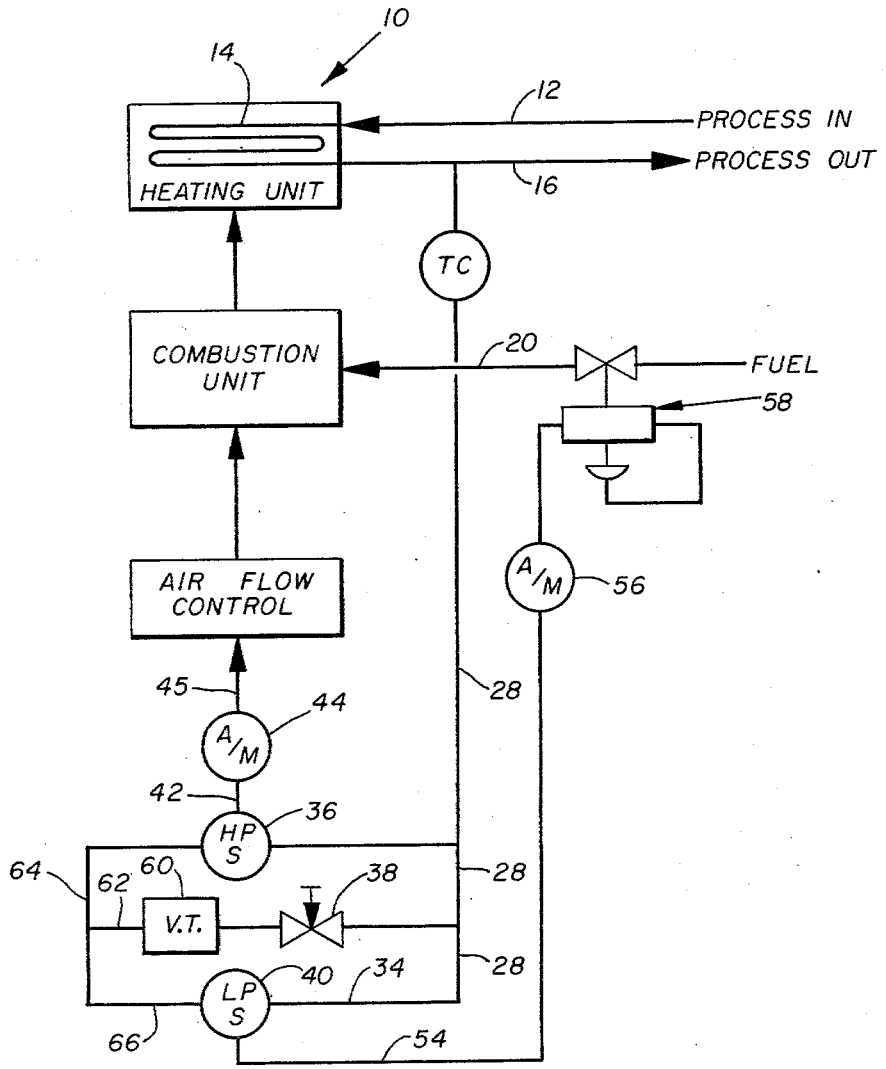
FIG. 3 is a schematic drawing of a combustion control system according to this invention.

In one embodiment of my invention as described in FIG. 3, line 24 provides communication between process outlet stream 16 and a temperature controller 26. Temperature controller 26 may be one of any conventional devices for measuring temperature and providing a signal to other equipment in response to that temperature. Thus, temperature controller 26 measures a temperature of the process stream and provides a fluid-pressure signal through lines 28, 30, 32, and 34, in parallel to a first fluid-responsive relay 36, a needle valve 38, and a second fluid-responsive relay 40.

First fluid-responsive relay 36 responds to an increasing pressure signal in lines 28 and 30 and transmits a signal through line 42 to an air flow control device 44, which, in this embodiment of my invention, further communicates a signal, through line 45, to a conventional pneumatic device 46, generally, which operates, through connection 48, louvers 50, positioned in air duct 52, to regulate the amount of combustion air.

Second fluid-responsive relay 40 responds to a decreasing pressure signal in lines 28 and 34 and transmits a signal through line 54 to a fuel control device 56, generally, which further transmits a signal through line 57 to fuel control valve 58, generally, which operates to control the amount of fuel transmitted to burner 18.

Needle valve 38 is preferably an adjustable valve, and is subject to the pressure condition, or change in pressure, in lines 28 and 32. Then, needle valve 38 may be adjusted to transmit, at a reduced rate, the pressure condition in line 32 to volume tank 60 through line 62. Thus, an increasing pressure level in volume tank 60 is delayed for a period of time dependent upon the degree of restriction provided by the adjustment of needle valve 38. Also, when there is a decreasing pressure signal in line 28, a decrease in the pressure level in volume tank 60 is delayed for a period of time dependent upon the degree of restriction in needle valve 38.

Volume tank 60 communicates in parallel with first fluid-responsive relay 36 and second fluid-responsive relay 40 through lines 62, 64, and 66.

Essentially, air flow control device 44 and fuel control device 56 are automatic/manual control devices which may be set at a particular point to respond to particular signals presented to them through lines 42 or 57 in order to control the flow of air and fuel. One example of such a control would be Foxboro Model 135S.

An example of a first fluid-responsive relay 36 is Foxboro Model BO114YL pneumatic relay. An example of a second fluid-responsive relay 40 is Foxboro Model BO114BZ pneumatic relay.

Figure 4:
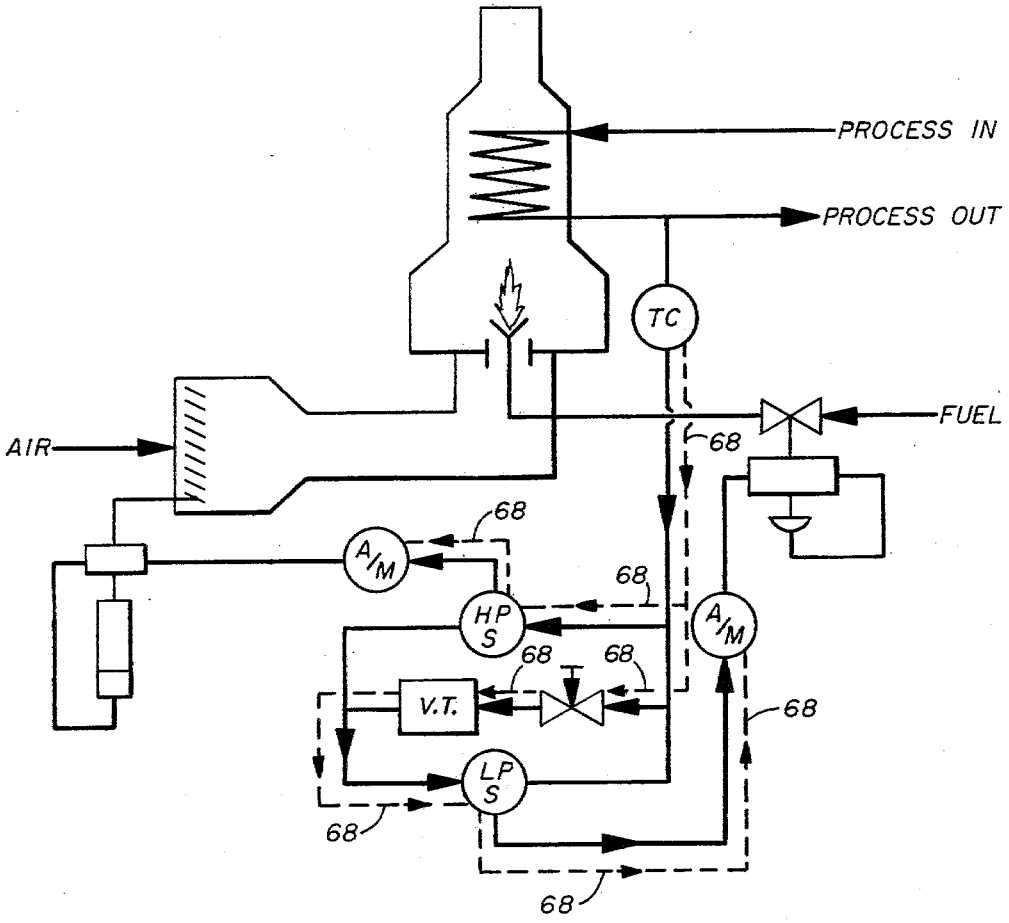
FIG. 4 is a schematic drawing of a combustion control system according to this invention in one particular mode of operating condition.

FIG. 4 describes a path of increasing pressure transmission 68 which originates from the signal generated by temperature controller 26. This path is to show the cooperation of the various controls and does not suggest that the type of signal and strength of signal are the same at all points along that path.

Figure 5:
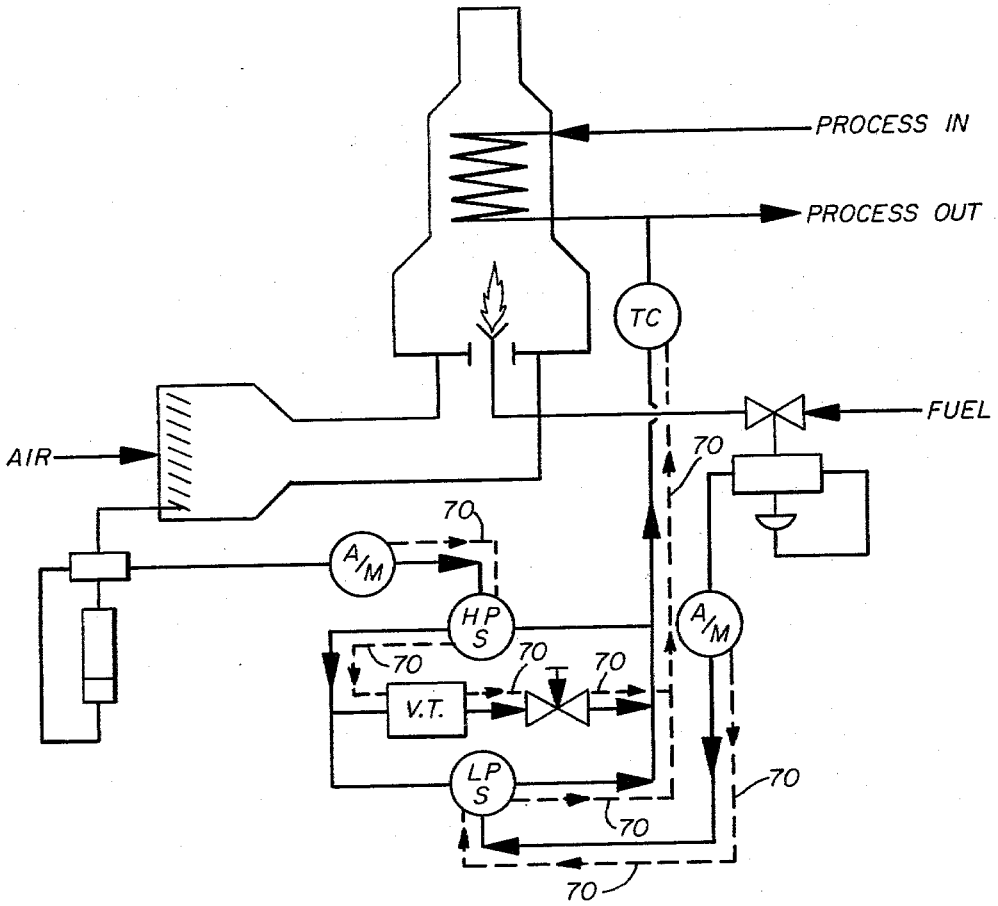
FIG. 5 is a schematic drawing of a combustion control system according to this invention in a second particular mode of operating condition.

FIG. 5 describes a path of decreasing pressure transmission 70 which also originates from a signal generated by temperature controller 26.

In a typical operation, temperature controller 26 is set at a chosen temperature so that it may emit a signal of increasing pressure when the temperature measured is below the set point, and so that it may emit a signal of decreasing pressure when the temperature measured is above the set point.

Thus, when the temperature is at the chosen, or set, point, the pressure magnitude remains constant.

When the temperature of the process stream 16 falls below the set point of temperature controller 26, temperature controller 26 emits a signal of increasing pressure which follows the path 68 shown in FIG. 4. This signal of increasing pressure is immediately transmitted through first fluid-responsive relay 36 to operate pneumatic device 46 to cause the flow of combustion air to increase promptly, before the flow of fuel is increased.

This signal of increasing fluid pressure is simultaneously transmitted through needle valve 38 and into and through volume tank 60, where, because of the restriction caused by needle valve 38, the pressure builds up gradually, and finally is relayed to the high pressure side of second fluid-responsive relay 40 to actuate relay 40 and be transmitted through relay 40 to actuate fuel control device 56. The signal of increasing pressure actuates fuel control device 56 to open, or further open, fuel control valve 58 and increase the flow of fuel to burner 18.

If the temperature indicated by temperature controller 26 is above its set point, then temperature controller 26 emits a signal of decreasing pressure which follows the path 70 shown in FIG. 5. This signal of decreasing fluid pressure is transmitted simultaneously through the low pressure side of fluid-responsive relay 40 and fuel control device 56 as well as through needle valve 38, through volume tank 60, and the low pressure side of first fluid-responsive relay 36. In this manner, the signal of decreasing pressure actuates fuel control device 56 immediately which acts to close fuel control valve 58 to some degree to reduce the flow of fuel to burner 18 before the flow of air to burner 18 is decreased. The signal of decreasing pressure is transmitted through needle valve 38 to volume tank 60, but only gradually reduces the fluid pressure in volume tank 60 so that the signal of decreasing pressure presented to first fluid-responsive relay 36 lags behind the time of the full signal presented to second fluid-responsive relay 40.

In either situation, as outlined above, an increasing pressure signal or a decreasing pressure signal, the arrangement of the needle valve and volume tank causes a delay in the response of either the first or second fluid-responsive relay so that a fuel-lean mixture is maintained during any change in the operating conditions of the process. It is readily seen, however, that opposite responsiveness of the temperature control and fuel and air control devices could be utilized and the same effectiveness of a fuel-lean mixture still maintained, the important responsiveness being a delay in the transmitting of the fuel control signals.

It is also clear that following any interval in which the firing rate is changed, the pressure level in the volume tank 60 reaches equilibrium and becomes constant with the fluid pressure signal and no change is induced in the flow of either the combustion air or the fuel.

Since many different embodiments of this invention may be made without departing from the spirit and scope thereof, it is to be understood that the specific embodiments described in detail herein are not to be taken in a limiting sense, since the scope of the invention is best defined by the appended claims.

I claim:

1. A combustion control apparatus, comprising:

a signal generating device adaptable to generate a signal from a condition of a process, the signal generating device adaptable to communicate a signal in parallel to a signal restrictive member, a first signal-responsive device, and a second signal-responsive device, the first signal-responsive device adapted to be responsive to a signal of a first characterization, the second signal-responsive device adapted to be responsive to a signal of a second characterization, the signal-restrictive member further adaptable to communicate a signal to a signal-collecting device, the signal-collecting device adaptable to provide a signal of a first characterization and a signal of a second characterization, the signal-collecting device adaptable to communicate in parallel with the first signal-responsive device and with the second signal-responsive device, the first signal-responsive device being further in communication with an air control device adaptable to control a flow of combustion air in response to a signal from the first signal-responsive device, and the second signal-responsive device being further in communication with a fuel control device adaptable to control a flow of fuel in response to a signal from the second signal-responsive device.

2. A combustion control apparatus as described in claim 1 wherein a signal from a condition of a process includes a fluid signal.

3. A combustion control apparatus as described in claim 2 wherein a condition of a process is a temperature of a process.

4. A combustion control apparatus as described in claim 3 wherein a first signal-responsive device includes a first fluid-responsive relay member, and a second signal-responsive device includes a second fluid-responsive relay member.

5. A combustion control apparatus as described in claim 4 wherein a signal-restrictive member includes a needle valve.

6. A combustion control apparatus as described in claim 5 wherein a signal-collecting device includes a fluid container.

7. A method of controlling combustion in a process comprising the steps of:

generating a signal from a condition of a process, communicating a signal in parallel to a signal restrictive member, a first signal-responsive device, and a second signal-responsive device, adapting the first signal-responsive device to be responsive to a signal of a first characterization, adapting the second signal-responsive device to be responsive to a signal of a second characterization, adapting the signal-restrictive member to communicate a signal to a signal-collecting device, adapting the signal-collecting device to provide a signal of a first characterization and a signal of a second characterization, adapting the signal-collecting device to communicate in parallel with the first signal-responsive device and with the second signal-responsive device, adapting the first signal-responsive device to communicate with an air control device controlling a flow of combustion air in response to a signal from the first signal-responsive device, and adapting the second signal-responsive device to communicate with a fuel control device controlling a flow of fuel in response to a signal from the second signal-responsive device.

8. A method of controlling combustion in a process as described in claim 7 wherein generating a signal from a condition of a process includes generating a fluid signal.

9. A method of controlling combustion in a process as described in claim 8 wherein generating a fluid signal from a condition of a process includes generating a fluid signal from a temperature of a process.

10. A method of controlling combustion in a process as described in claim 9 wherein communicating a signal to a signal-restrictive member, adapting the signal-restrictive member to communicate a signal to a signal-collecting device, include communicating a signal to a needle valve, and adapting the needle valve to communicate a signal to a signal-collecting device.

11. A method of controlling combustion in a process as described in claim 10 wherein adapting the needle valve to communicate a signal to a signal-collecting device, adapting the signal-collecting device to provide a signal of a first characterization and a signal of a second characterization, adapting the signal-collecting device to communicate in parallel with the first signal-responsive device and with the second signal-responsive device, include adapting the needle valve to communicate a signal to a fluid container, adapting the fluid container to provide a signal of a first characterization and a signal of a second characterization, adapting the fluid container to communicate in parallel with the first signal-responsive device and with the second signal-responsive device.

12. A method of controlling combustion in a process comprising the steps of:

generating a fluid signal from a temperature of a process, communicating a signal in parallel to a needle valve, a first fluid-responsive relay member, and a second fluid-responsive relay member, adapting the first fluid-responsive relay member to be responsive to a signal of a first characterization, adapting the second fluid-responsive relay member to be responsive to a signal of a second characterization, adapting the needle valve to communicate a signal to a fluid container, adapting the fluid container to provide a signal of a first characterization and a signal of a second characterization, adapting the fluid container to communicate in parallel with the first fluid-responsive relay member and with the second fluid-responsive relay member, adapting the first fluid-responsive relay member to communicate with an air control device controlling a flow of combustion air in response to a signal from the first fluid-responsive relay member, and adapting the second fluid-responsive relay member to communicate with a fuel control device controlling a flow of fuel in response to a signal from the second fluid-responsive relay member.

* * * * *